US008126707B2

(12) United States Patent
Ertan et al.

(10) Patent No.: US 8,126,707 B2
(45) Date of Patent: Feb. 28, 2012

(54) METHOD AND SYSTEM FOR SPEECH COMPRESSION

(75) Inventors: Ali Erdem Ertan, Dallas, TX (US); Jacek Stachurski, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 853 days.

(21) Appl. No.: 12/098,225

(22) Filed: Apr. 4, 2008

(65) Prior Publication Data

US 2008/0249768 A1 Oct. 9, 2008

Related U.S. Application Data

(60) Provisional application No. 60/910,308, filed on Apr. 5, 2007.

(51) Int. Cl.
*G10L 19/00* (2006.01)

(52) U.S. Cl. ..... 704/219; 704/222; 704/E19.035

(58) Field of Classification Search ..... 704/219, 704/222, E19.035
See application file for complete search history.

(56) References Cited

U.S. PATENT DOCUMENTS

| | | | | |
|---|---|---|---|---|
| 5,699,477 | A * | 12/1997 | McCree | 704/216 |
| 5,749,065 | A * | 5/1998 | Nishiguchi et al. | 704/200.1 |
| 5,966,689 | A * | 10/1999 | McCree | 704/226 |
| 6,122,608 | A | 9/2000 | McCree | |
| 6,775,649 | B1 * | 8/2004 | DeMartin | 704/201 |
| 6,826,527 | B1 * | 11/2004 | Unno | 704/223 |
| 6,889,185 | B1 | 5/2005 | McCree | |
| 7,295,974 | B1 | 11/2007 | Stachurski | |
| 7,324,937 | B2 * | 1/2008 | Thyssen et al. | 704/219 |
| 7,693,710 | B2 * | 4/2010 | Jelinek et al. | 704/207 |
| 2003/0167170 | A1 * | 9/2003 | Andrsen et al. | 704/270 |
| 2004/0010407 | A1 * | 1/2004 | Kovesi et al. | 704/219 |
| 2005/0065782 | A1 * | 3/2005 | Stachurski | 704/205 |
| 2005/0065786 | A1 * | 3/2005 | Stachurski et al. | 704/211 |
| 2005/0065787 | A1 * | 3/2005 | Stachurski | 704/229 |
| 2005/0065788 | A1 * | 3/2005 | Stachurski | 704/229 |
| 2005/0091048 | A1 * | 4/2005 | Thyssen et al. | 704/223 |
| 2005/0154584 | A1 * | 7/2005 | Jelinek et al. | 704/219 |

FOREIGN PATENT DOCUMENTS

EP 1035538 B1 * 7/2005

OTHER PUBLICATIONS

McCree. "A Scalable Phonetic Vocoder Framework Using Joint Predictive Vector Quantization of MELP Parameters" 2006.*

(Continued)

*Primary Examiner* — Richemond Dorvil
*Assistant Examiner* — Greg Borsetti
(74) *Attorney, Agent, or Firm* — Mirna Abyad; Wade J. Brady, III; Frederick J. Telecky, Jr.

(57) ABSTRACT

Methods, encoders, and digital systems are provided for predictive encoding of speech parameters in which an input frame is encoded by quantizing a parameter vector of the input frame with a strongly-predictive codebook and a weakly-predictive codebook to obtain a strongly-predictive distortion and a weakly-predictive distortion, adjusting a correlation indicator based on a relative correlation of the input frame to a previous frame, wherein the correlation indicator is indicative of the strength of the correlation of previously encoded frames, and encoding the input frame with the weakly-predictive codebook unless the correlation indicator has reached a correlation threshold.

16 Claims, 7 Drawing Sheets

OTHER PUBLICATIONS

Supplee et al. "MELP: The New Federal Standard At 2400 BPS" 1997.*

Stachurski et al. "High Quality MELP Coding at Bit-Rates Around 4 KB/S" 1999.*

McCree et al "A 4 KB/S Hybrid MELP/CELP Speech Coding Candidate for ITU Standardization" 2002.*

McCree et al. "A 1.7 KB/s MELP Coder With Improved Analysis and Quantization" 1998.*

Eriksson et al. "Exploiting Interframe Correlation in Spectral Quantization" 1995.*

Unno et al. "A Robust Narrowband to Wideband Extension System Featuring Enhanced Codebook Mapping" 2005.*

Chibani et al. "Resynchronization of the Adaptive Codebook in a Constrained CELP Codec After a Frame Erasure" 2006.*

Ertan, Ali Erdem, "Method and System for Reducing Frame Erasure Related Error Propagation in Predictive Speech Parameter Coding", U.S. Appl. No. 12/062,767, filed Apr. 4, 2008.

* cited by examiner

METHOD AND SYSTEM FOR SPEECH COMPRESSION

CROSS REFERENCE TO RELATED APPLICATIONS

The present application claims priority to U.S. Provisional Patent Application No. 60/910,308, filed on Apr. 5, 2007, entitled "CELP System and Method" which is incorporated by reference. The following co-assigned patent discloses related subject matter: U.S. Pat. No. 7,295,974, filed on Mar. 9, 2000, entitled "Encoding in Speech Compression" which is incorporated by reference.

BACKGROUND OF THE INVENTION

The performance of digital speech systems using low bit rates has become increasingly important with current and foreseeable digital communications. Both dedicated channel and packetized voice-over-internet protocol (VoIP) transmission benefit from compression of speech signals. Linear prediction (LP) digital speech coding is one of the widely used techniques for parameter quantization in speech coding applications. This predictive coding method removes the correlation between the parameters in adjacent frames, and thus allows more accurate quantization at same bit-rate than non-predictive quantization methods. Predictive coding is especially useful for stationary voiced segments as parameters of adjacent frames have large correlations. In addition, the human ear is more sensitive to small changes in stationary signals, and predictive coding allows more efficient encoding of these small changes.

The predictive coding approach to speech compression models the vocal tract as a time-varying filter and a time-varying excitation of the filter to mimic human speech. Linear prediction analysis determines LP coefficients a(j), j=1, 2, . . . , M, for an input frame of digital speech samples {s(n)} by setting $$r(n)=s(n)-\Sigma_{M\geqq j\geqq 1}a(j)s(n-j) \tag{0}$$

and minimizing $\Sigma_{frame}\, r(n)^2$ with respect to a(j). Typically, M, the order of the linear prediction filter, is taken to be about 8-16; the sampling rate to form the samples s(n) is typically taken to be 8 or 16 kHz; and the number of samples {s(n)} in a frame is often 80 or 160 for 8 kHz or 160 or 320 for 16 kHz. Various windowing operations may be applied to the samples of the input speech frame. The name "linear prediction" arises from the interpretation of the residual $r(n)=s(n)-\Sigma_{M\geqq j\geqq 1}\, a(j)\, s(n-j)$ as the error in predicting s(n) by a linear combination of preceding speech samples $\Sigma_{M\geqq j\geqq 1}\, a(j)s(n-j)$, i.e., a linear autoregression. Thus, minimizing $\Sigma_{frame} r(n)^2$ yields the {a(j)} which furnish the best linear prediction. The coefficients {a(j)} may be converted to line spectral frequencies (LSFs) or immittance spectrum pairs (ISPs) for vector quantization plus transmission and/or storage.

The {r(n)} form the LP residual for the frame, and ideally the LP residual would be the excitation for the synthesis filter 1/A(z) where A(z) is the transfer function of equation (0); that is, equation (0) is a convolution which corresponds to multiplication in the z-domain: R(z)=A(z)S(z), so S(z)=R(z)/A(z). Of course, the LP residual is not available at the decoder; thus the task of the encoder is to represent the LP residual so that the decoder can generate an excitation for the LP synthesis filter. Indeed, from input encoded (quantized) parameters, the decoder generates a filter estimate, $\hat{A}(z)$, plus an estimate of the residual to use as an excitation, E(z), and thereby estimates the speech frame by $\hat{S}(z)=E(z)/\hat{A}(z)$. Physiologically, for voiced frames, the excitation roughly has the form of a series of pulses at the pitch frequency, and for unvoiced frames the excitation roughly has the form of white noise.

For speech compression, the predictive coding approach basically quantizes various parameters with respect to their values in the previous frame and only transmits/stores updates or codebook entries for these quantized parameters. A receiver regenerates the speech with the same perceptual characteristics as the input speech. Periodic updating of the quantized items requires fewer bits than direct representation of the speech signal, so a reasonable LP encoder can operate at bits rates as low as 2-3 kb/s (kilobits per second).

For example, the Adaptive Multirate Wideband (AMR-WB) encoding standard with available bit rates ranging from 6.6 kb/s up to 23.85 kb/s uses LP analysis with codebook excitation (CELP) to compress speech. An adaptive-codebook contribution provides periodicity in the excitation and is the product of a gain, $g_P$, multiplied by v(n), the excitation of the prior frame translated by the pitch lag of the current frame and interpolated to fit the current frame. An algebraic codebook contribution approximates the difference between the actual residual and the adaptive codebook contribution with a multiple-pulse vector (also known as an innovation sequence), c(n), multiplied by a gain, $g_C$. The number of pulses depends on the bit rate. That is, the excitation is $u(n)=g_P\, v(n)+g_C\, c(n)$ where v(n) comes from the prior (decoded) frame, and $g_P$, $g_C$, and c(n) come from the transmitted parameters for the current frame. The speech synthesized from the excitation is then postfiltered to mask noise. Postfiltering essentially involves three successive filters: a short-term filter, a long-term filter, and a tilt compensation filter. The short-term filter emphasizes formants; the long-term filter emphasizes periodicity, and the tilt compensation filter compensates for the spectral tilt typical of the short-term filter.

Predictive quantization can be applied to almost all parameters in speech coding applications including linear prediction coefficients (LPC), gain, pitch, speech/residual harmonics, etc. In this technique, the mean of the parameter vector, $\mu_x$, is first subtracted from the quantized parameter vector in the prior frame ($k-1^{st}$ frame), $\hat{x}^{k-1}$, and then, the current frame ($k^{th}$ frame) is predicted from the prior frame as:

$$\breve{x}^k=A(\hat{x}^{k-1}-\mu_x), \tag{1}$$

where A is the prediction matrix and $\breve{x}^k$ is the mean removed predicted vector of the current frame. When the correlation among the elements of the parameter vector is zero such as in line spectral frequencies (LSF) or immitance spectral frequencies (ISF), A is a diagonal matrix. After this step, the difference vector, $d^k$, between the predicted and the mean-removed unquantized parameter vector, $x^k$, is calculated as $$d^k=(x^k-\mu_x)-\breve{x}^k. \tag{2}$$

This difference vector is then quantized and sent to the decoder.

In the decoder, the current frame's parameter vector is first predicted using (1), and then the quantized difference vector and the mean vector are added to find the quantized parameter vector, $\hat{x}^k$:

$$\hat{x}^k=\breve{x}^k+\hat{d}^k+\mu_x, \tag{3}$$

where $\hat{d}^k$ is the quantized version of the difference vector calculated with (2).

In a typical quantization system, A and $\mu_x$ are obtained by a training procedure using a set of vectors. $\mu_x$ is obtained as the mean of the vectors in this set, and A is chosen to minimize the summation of squared $d^k$ in all frames. The difference vector, $d^k$, may be coded with any quantization technique (e.g., scalar and vector quantization) that is designed to optimally quantize difference vectors.

Further, in a typical quantization system, the vector quantization is essentially a lookup process, where a lookup table is referred to as a "codebook." A codebook lists each quantization level, and each level has an associated "code-vector." The quantization process compares an input vector to the code-vectors and determines the best code-vector in terms of minimum distortion. Some quantization systems implement multi-stage vector quantization (MSVQ) in which multiple codebooks are used. In MSVQ, a central quantized vector (i.e., the output vector) is obtained by adding a number of quantized vectors. The output vector is sometimes referred to as a "reconstructed" vector. Each vector used in the reconstruction is from a different codebook and each codebook corresponds to a "stage" of the quantization process. Each codebook is designed especially for a stage of the search. An input vector is quantized with the first codebook, and the resulting error vector (i.e., difference vector) is quantized with the second codebook, etc. The set of vectors used in the reconstruction may be expressed as:

$$y^{(j_0 j_1, \ldots j_{s-1})} = y_0^{(j_1)} + y_1^{(j_1)} + \ldots + y_{s-1}^{(j_{s-1})} \quad (4)$$

where s is the number of stages and $y_s$ is the codebook for the sth stage. For example, for a three-dimensional input vector, such as x=(2,3,4), the reconstruction vectors for a two-stage search might be $y_0$=(1,2,3) and $y_1$=(1,1,1) (a perfect quantization and not always the case).

During MSVQ, the codebooks may be searched using a sub-optimal tree search algorithm, also known as an M-algorithm. At each stage, M-best number of "best" code-vectors are passed from one stage to the next. The "best" code-vectors are selected in terms of minimum distortion. The search continues until the final stage, where only one best code-vector is determined. One example of an MSVQ quantizer is described in U.S. Pat. No. 6,122,608 filed on Aug. 15, 1998, entitled "Method for Switched Predictive Quantization".

While predictive coding is one of the widely used techniques for parameter quantization in speech coding applications, any error that occurs in one frame propagates into subsequent frames. In particular, for VoIP, the loss or delay of packets or other corruption can lead to erased frames. There are a number of techniques to combat error propagation including: (1) using a moving average (MA) filter that approximates the IIR filter which limits the error propagation to only a small number of frames (equal to the MA filter order); (2) reducing the prediction coefficient artificially and designing the quantizer accordingly so that an error decays faster in subsequent frames; and (3) using switched-predictive quantization (or safety-net quantization) techniques in which two different codebooks with two different predictors (i.e., prediction matrices) are used and one of the predictors is chosen small (or zero in the case of safety-net quantization) so that the error propagation is limited to the frames that are encoded with strong prediction.

Switched-predictive quantization (or safety-net quantization) is often used to encode speech parameters that have multiple classes of unique statistical characteristics; a speech signal has both stationary segments in which the parameter vectors of the frames have large correlations from one frame to the next and transition segments in which the parameter vectors of the frames change rapidly between successive frames and thus have low correlations from one frame to the next. Typically, when switched predictive quantization is used for speech, two predictor/codebook pairs are used: one weakly-predictive codebook with a small prediction coefficient (i.e., prediction matrix) that is close to zero and one strongly-predictive codebook with a large prediction coefficient that is close to one. In the encoder, the parameter vector of a frame is quantized with both predictor/codebook pairs, and the predictor/quantizer pair providing the lesser quantization distortion is chosen. One example of a switched-predictive quantizer is the MSVQ quantizer described in the previously mentioned U.S. Pat. No. 6,122,608.

As previously mentioned, switched-predictive quantization may provide additional encoding robustness in the presence of frame erasures. Because the prediction coefficient associated with a weakly-predictive codebook is small, the propagated error due to a prior erased frame decays much faster when a weakly-predictive codebook is used. For this reason, the use of the weakly-predictive codebook is desired whenever possible. Further, if a safety-net codebook is used instead of a weakly-predictive codebook, the propagation error vanishes. Accordingly, use of a safety-net codebook is also desired whenever possible.

However, if a transition frame is lost because of a frame erasure and it is constructed with a frame erasure concealment technique in the decoder, it is highly probable that reconstructed frame is significantly different from the actual one, and many of the following stationary frames that are encoded with the strongly-predictive codebook will have that large error as the error does not decay rapidly when strong prediction is used. One approach to decreasing the error propagation in such cases is described in the cross-referenced U.S. Pat. No. 7,295,974. The cross-referenced patent describes a technique for decreasing the error propagation due to frame erasure in which the first stationary frame following a transition frame is also encoded with a weakly-predictive codebook. More specifically, this technique causes the first stationary frame occurring after a transition frame (which is encoded with a weakly-predictive codebook) to always be encoded with the weakly-predictive codebook even if the quantization distortion of the weakly-predictive codebook is not smaller than the quantization distortion of the strongly-predictive codebook. Thus, even if the transition frame is erased, the error decays faster because of the low prediction coefficient of the weakly-predictive codebook. As a result, a large error does not propagate into the subsequent frames encoded with the strongly-predictive codebook.

When this technique is used, the parameters of the first stationary frame may, under some circumstances, be quantized with a large quantization distortion. As discussed above, the weakly-predictive codebook is trained for transition frames. Therefore, if the weakly-predictive codebook is used for a stationary frame, the quantization distortion could possibly be significantly larger than the quantization distortion if the strongly-predictive codebook is used. In addition, because the human ear is more sensitive to small changes in stationary frames, the increased quantization distortion may result in slight speech quality loss when there are no frame-erasures in the decoder.

SUMMARY OF THE INVENTION

Embodiments of the invention provide methods and systems for reducing error propagation due to frame erasure in predictive coding of speech parameters. More specifically, embodiments of the invention provide techniques for weak/strong predictive codebook selection such that clean-channel quality is not sacrificed to improve frame-erasure performance. That is, embodiments of the invention allow, under certain conditions, the use of a strongly-predictive codebook to encode the first stationary frame after a transition frame is encoded with the weakly predictive codebook rather than always forcing the use of the weakly-predictive codebook for such a stationary frame as disclosed in the prior art. In general, in embodiments of the invention, a parameter vector of an input frame is quantized with a strongly-predictive codebook and a weakly-predictive codebook, a correlation indicator is adjusted based on a relative correlation of the input frame to a previous frame, wherein the correlation indicator is indicative of the strength of the correlation of previously encoded frames, and the input frame is encoded with the weakly-predictive codebook unless the correlation indicator has reached a correlation threshold. The correlation threshold approximates a level of correlation at which the strongly-predictive codebook may be used.

BRIEF DESCRIPTION OF THE DRAWINGS

Particular embodiments in accordance with the invention will now be described, by way of example only, and with reference to the accompanying drawings.

DETAILED DESCRIPTION OF EMBODIMENTS OF THE INVENTION

Figure 1A:
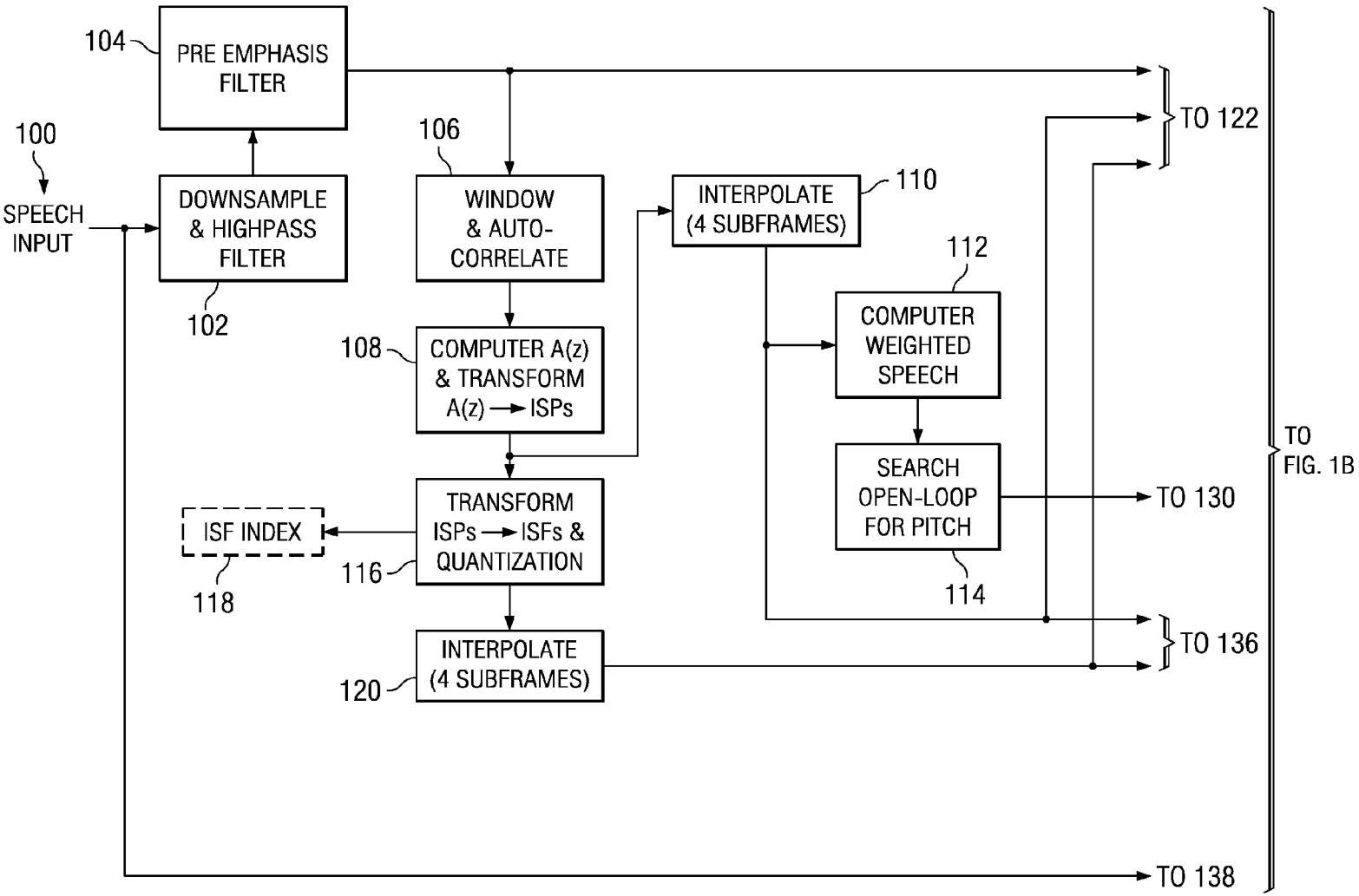
FIG. 1 shows a block diagram of a speech encoder in accordance with one or more embodiments of the invention.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description. In addition, although method steps may be presented and described herein in a sequential fashion, one or more of the steps shown and described may be omitted, repeated, performed concurrently, and/or performed in a different order than the order shown in the figures and/or described herein. Accordingly, embodiments of the invention should not be considered limited to the specific ordering of steps shown in the figures and/or described herein. Further, while embodiments of the invention may be described for LSFs (or ISFs) herein, one of ordinary skill in the art will know that the same quantization techniques may be used for immitance spectral frequencies (ISFs) (or LSFs) without modification as LSFs and ISFs have similar statistical characteristics.

In general, embodiments of the invention provide for the reduction of error propagation due to frame erasure in switched-predictive coding of speech parameters. Encoding methods, encoders, and digital systems are provided which determine when to force the use of a weakly-predictive codebook during encoding of a speech signal. More specifically, rather than always forcing the use of a weakly-predictive codebook for the first stationary frame occurring after a transition frame that is encoded with a weakly predicted codebook as in the prior art, the use of a strongly-predictive codebook is allowed for such a frame when there is sufficient correlation between the frame and previously encoded frames. In other words, if the speech signal at the point this first stationary frame is encountered is sufficiently stationary, the frame may be encoded using the strongly-predictive codebook.

In one or more embodiments of the invention, the relative correlation of frames in the speech signal is approximated by a correlation indicator. When a transition frame is encoded using a weakly-predictive codebook immediately after a frame that is encoded using a strongly-predictive codebook, this correlation indicator is set to indicate no correlation between frames. Then, for subsequent frames, the correlation indicator is adjusted based on the relative correlation of the current frame to the previous frame. In some embodiments of the invention, the amount the correlation indicator is adjusted is selected depending on whether there is no correlation, some correlation, or strong correlation. Further, the determination of whether there is no correlation, some correlation, or strong correlation is based on various conditions (explained herein) that approximate the relative correlation of the current frame to the previous frame. After the parameter vector of the current frame is quantized, the correlation indicator is compared to a correlation threshold to determine whether the use of a weakly-predictive codebook for encoding the frame should be forced or the use of a strongly-predictive codebook may be allowed. The correlation threshold may be set based on a tradeoff between clean channel quality and frame erasure robustness.

In one or more embodiments of the invention, the encoders perform coding using digital signal processors (DSPs), general purpose programmable processors, application specific circuitry, and/or systems on a chip such as both a DSP and RISC processor on the same integrated circuit. Codebooks may be stored in memory at both the encoder and decoder, and a stored program in an onboard or external ROM, flash EEPROM, or ferroelectric RAM for a DSP or programmable processor may perform the signal processing. Analog-to-digital converters and digital-to-analog converters provide coupling to analog domains, and modulators and demodulators (plus antennas for air interfaces) provide coupling for transmission waveforms. The encoded speech may be packetized and transmitted over networks such as the Internet to another system that decodes the speech.

Figure 1B:
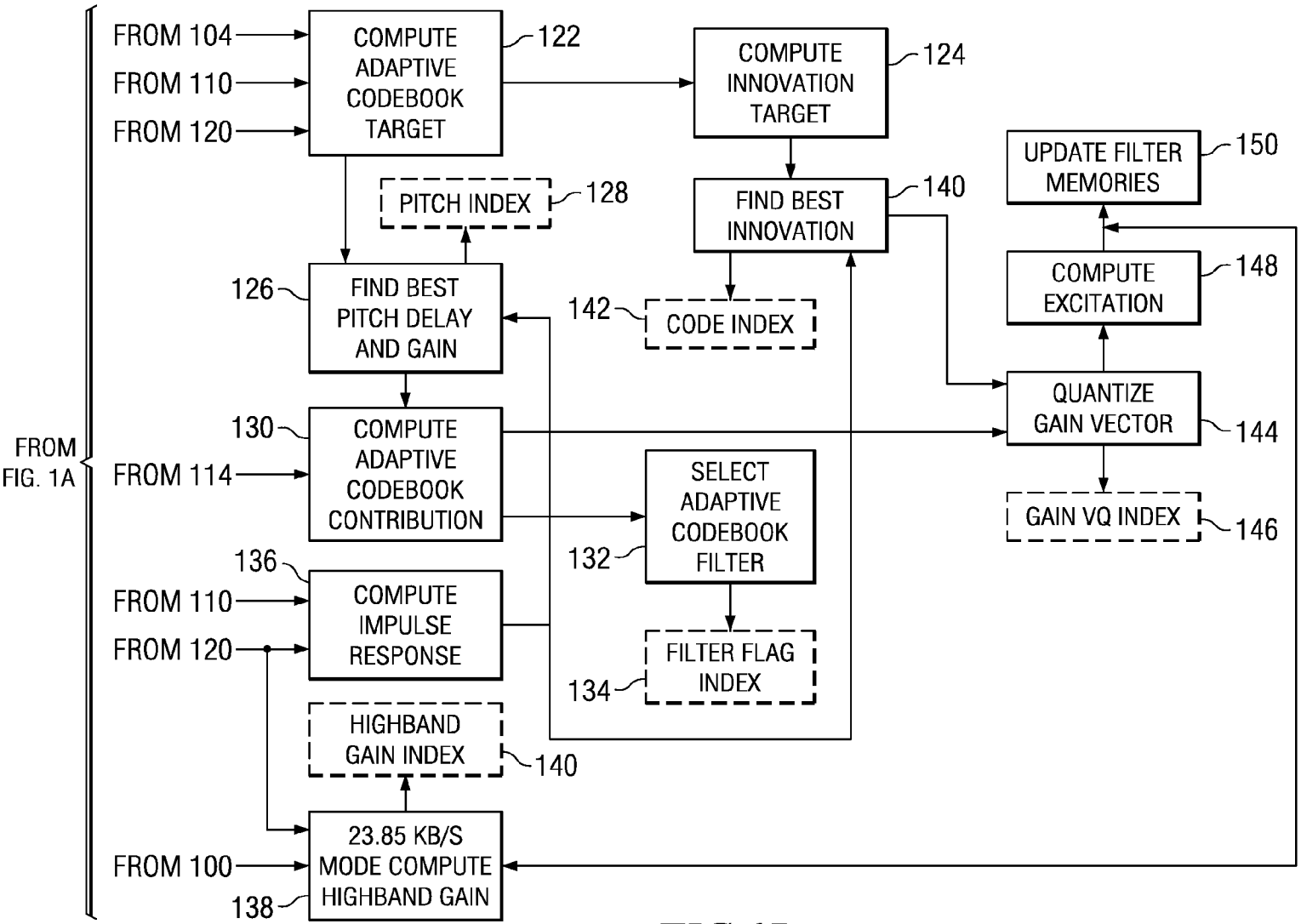

FIG. 1 is a block diagram of a speech encoder in accordance with one or more embodiments of the invention. More specifically, FIG. 1 shows the overall architecture of an AMR-WB speech encoder. The encoder receives speech input (100), which may be in analog or digital form. If in analog form, the input speech is then digitally sampled (not shown) to convert it into digital form. The speech input (100) is then down sampled as necessary and highpass filtered (102) and pre-emphasis filtered (104). The filtered speech is windowed and autocorrelated (106) and transformed first into LPC filter coefficients in the A(z) form and then into ISPs (108).

The ISPs are interpolated (110) to yield ISPs in (e.g., four) subframes. The perceptually weighted speech is computed for the subframes (112) and searched to determine the pitch in an open-loop fashion (114). The ISPs are also further transformed into immitance spectral frequencies (ISFs) and quantized (116). In one or more embodiments of the invention, the ISFs are quantized in accordance with predictive coding techniques as described below in reference to FIGS. 2 and 4. The quantized ISFs are stored in an ISF index (118) and interpolated (120) to yield quantized ISFs in (e.g., four) subframes.

The speech that was emphasis-filtered (104), the interpolated ISPs, and the interpolated, quantized ISFs are employed to compute an adaptive codebook target (122), which is then employed to compute an innovation target (124). The adaptive codebook target is also used, among other things, to find a best pitch delay and gain (126), which is stored in a pitch index (128).

The pitch that was determined by open-loop search (114) is employed to compute an adaptive codebook contribution (130), which is then used to select and adaptive codebook filter (132), which is then in turn stored in a filter flag index (134).

The interpolated ISPs and the interpolated, quantized ISFs are employed to compute an impulse response (136). The interpolated, quantized ISFs, along with the unfiltered digitized input speech (100), are also used to compute highband gain for the 23.85 kb/s mode (138).

The computed innovation target and the computed impulse response are used to find a best innovation (140), which is then stored in a code index (142). The best innovation and the adaptive codebook contribution are used to form a gain vector that is quantized (144) in a Vector Quantizer (VQ) and stored in a gain VQ index (146). The gain VQ is also used to compute an excitation (148), which is finally used to update filter memories (150).

Figure 2:
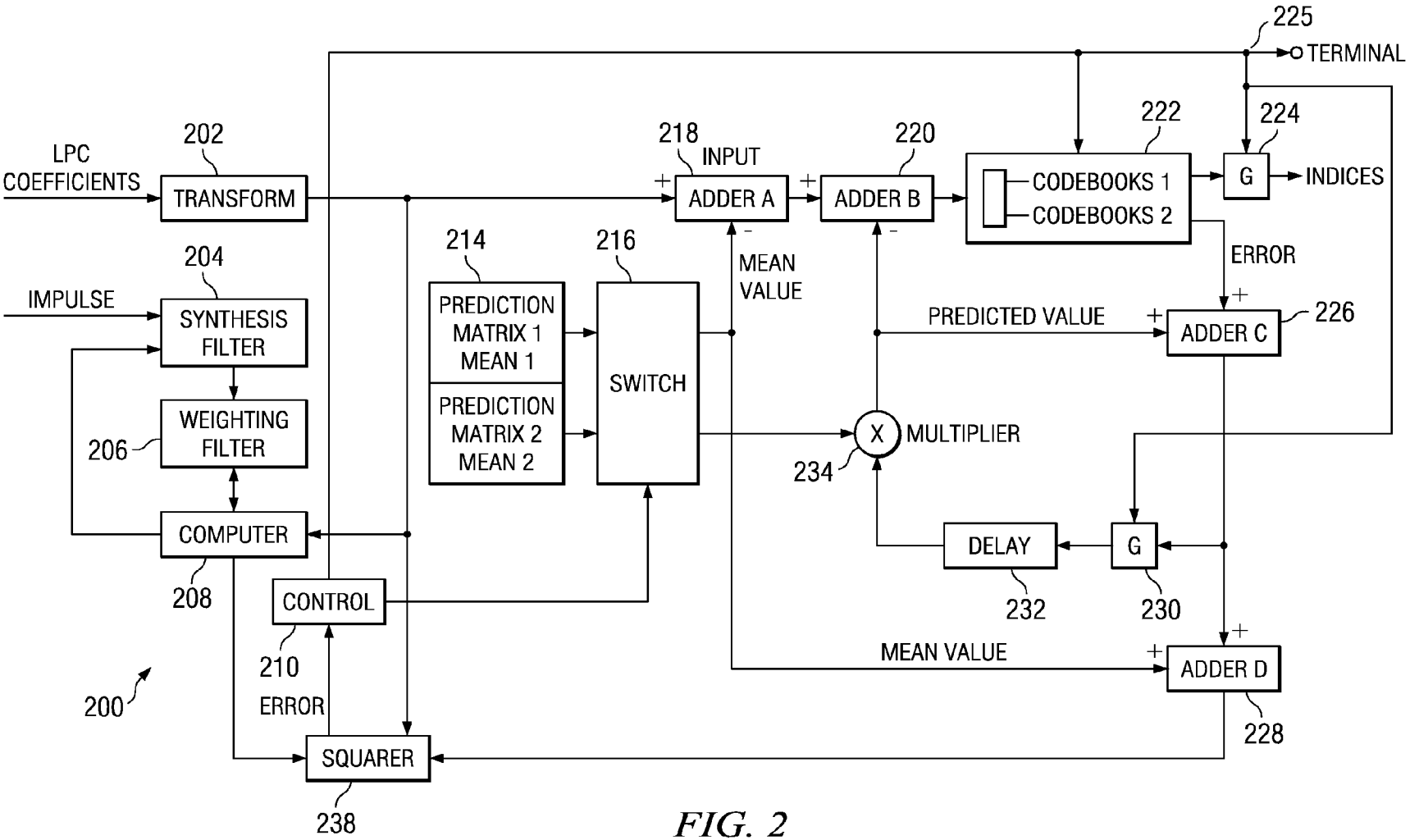
FIG. 2 shows a block diagram of a predictive encoder in accordance with one or more embodiments of the invention.

FIG. 2 shows a block diagram of a predictive encoder in accordance with one or more embodiments of the invention. More specifically, the predictive encoder of FIG. 2 is an LSF encoder with a switched predictive quantizer. As is described below, the encoder of FIG. 2 is arranged to allow, under certain conditions, the use of a strongly-predictive codebook to encode the first stationary frame after a transition frame is encoded with the weakly predictive codebook rather than always forcing the use of the weakly predictive codebook for such a stationary frame as disclosed in the prior art.

In the encoder of FIG. 2, two prediction matrix/mean vector/codebook sets are used: the first set is prediction matrix 1, mean vector 1, and codebooks 1 where the codebooks 1 and the prediction matrix 1 are trained to be strongly-predictive and the second set is prediction matrix 2, mean vector 2, and codebooks 2 where the codebooks 2 and the prediction matrix 2 are trained to be weakly-predictive. In one or more embodiments of the invention, the prediction coefficients in the weakly-predictive prediction matrix may be zero (i.e., safety-net quantization is used). In other embodiments of the invention, the prediction coefficients in the weakly-predictive prediction matrix may have values that are close to 0. In the encoder of FIG. 2, LPC coefficients for the current frame k are transformed by the transformer (202) to LSF coefficients of the LSF vectors. The resulting LSF input vector $x^k$ is then quantized with each of the prediction matrix/mean vector/codebook sets. Initially, the control (210) applies control signals to switch in via switch (216) prediction matrix 1 (i.e., the strongly-predictive predictor) and mean vector 1 from encoder storage (214) and to cause the strongly-predictive codebooks (i.e., codebooks 1) to be used in the quantizer (222). The LSF input vector $x^k$ is subtracted in adder A (218) by a selected mean vector $\mu_x$ (i.e., mean 1) and the resulting mean-removed input vector is subtracted in adder B (220) by a predicted value $\check{x}^k$. The predicted value $\check{x}^k$ is the previous mean-removed quantized vector (i.e., $\hat{x}^{k-1}-\mu_x$) multiplied by a known prediction matrix A (e.g., prediction matrix 1 and prediction matrix 2) at the multiplier (234). The process for supplying the mean-removed quantized vector for the previous frame to the multiplier (234) is described below.

The output of adder B (220) is a difference vector $d^k$ for the current frame k. This difference vector is applied to the multi-stage vector quantizer (MSVQ) (222). The output of the quantizer (322) is the quantized difference vector $\hat{d}^k$ (i.e., error) selected using the strongly-predictive codebooks. The predicted value from the multiplier (234) is added to the quantized output vector $\hat{d}^k$ from the quantizer (222) at adder C (226) to produce a quantized mean-removed vector. This quantized mean-removed vector is added at adder D (228) to the selected mean vector $\mu_x$ (i.e., mean 1) to get the quantized vector $\hat{x}^k$. The quantized mean-removed vector from adder C (226) is also gated (230) to the frame delay A (232) so as to provide the mean-removed quantized vector for the previous frame k−1, i.e., $\hat{x}^{k-1}-\mu_x$, to the multiplier (234).

The quantized vector $\hat{x}^k$ is provided to the squarer (238) where the squared error for each dimension is determined. The weighted squared error between the input vector $x_i$ and the delayed quantized vector $\hat{x}_i$ (i.e., the strongly-predictive weighted squared error) is stored at the control (210). This strongly-predictive weighted squared error is the distortion of the selected index of the strongly-predictive codebooks and may be referred to as the strongly-predictive distortion. The determination of the weighted squared error (i.e., measured error) is discussed in more detail below.

The control (210) then applies control signals to switch in via the switch (216) prediction matrix 2, (i.e., the weakly-predictive predictor) and mean vector 2 from encoder storage (214) and to cause the weakly-predictive codebooks (i.e., codebooks 2) to be used in the quantizer (222) to likewise measure the weighted squared error for these selections at the squarer (238). The weighted squared error between the input vector $x_i$ and the delayed quantized vector $\hat{x}_i$ (i.e., the weakly-predictive weighted squared error) is also stored at the control (210). This weakly-predictive weighted squared error is the distortion of the selected index of the weakly-predictive codebooks and may be referred to as the weakly-predictive distortion.

To determine the weighted squared error, a weighting $w_i$ is applied to the squared error at the squarer (238). The weighting $w_i$ is an optimal LSF weight for unweighted spectral distortion and may be determined as described in U.S. Pat. No. 6,122,608 filed on Aug. 15, 1998, entitled "Method for Switched Predictive Quantization" or using other known techniques for determining weighting. The weighted output $\epsilon$ (i.e., the weighted squared error) from the squarer (238) is $$\epsilon=\Sigma_i w_i(x_i-\hat{x}_i)^2$$

The computer (208) is programmed as described in the aforementioned U.S. Pat. No. 6,122,608 to compute the LSF weights $w_i$ using the LPC synthesis filter (204) and the perceptual weighting filter (206). The computed weight value from the computer (208) is then applied at the squarer (238) to determine the weighted squared error.

Once the strongly-predictive weighted squared error and the weakly-predictive weighted squared error are determined, the control (210) and the computer (208) are used to determine whether the use of the weakly-predictive codebooks should be forced for the current frame k. More specifically, in one or more embodiments of the invention, the control (210) and the computer (208) make this determination in accordance with the pseudo-code in Table 1 below. If the use of the weakly-predictive codebooks is forced, the set of indices for the weakly-predictive codebooks is gated (224) out of the encoder as an encoded transmission of indices and a bit is sent out at the terminal (225) from the control (210) indicating that the indices were sent from the weakly-predictive codebooks and the weakly-predictive prediction matrix.

If the use of the weakly-predictive codebooks is not forced, then other criteria are used to select which of the codebooks is to be used. For example, the weakly-predictive weighted squared error may be compared with the strongly-predictive squared error and the codebooks with the minimum error (i.e., lesser distortion) selected for use. Once the other criteria are applied, the set of indices for the selected codebooks (i.e., the weakly-predictive codebooks or the strongly-predictive codebooks) is gated (224) out of the encoder as an encoded transmission of indices and a bit is sent out at the terminal (225) from the control (210) indicating from which prediction matrix/codebooks the indices were sent (i.e., the weakly-predictive codebooks and prediction matrix or the strongly-predictive codebooks and prediction matrix).

Table 1 contains the previously mentioned pseudo-code. The process described in this pseudo-code is performed in the encoder for each input frame. The frame erasure concealment (FEC) mentioned in the pseudo-code is the same frame erasure concealment that is used in the decoder that will receive the encoded frames. In embodiments of the invention, FEC is used in this decision process to simulate what might happen in decoder if the previous frame is erased. Frame erasure concealment techniques are known in the art and any such technique may be used in embodiments of the invention.

Further, this pseudo-code assumes that a counter is initially set to 0 before processing of the speech frames begins. The value of this counter, which may also be referred to as the correlation indicator, is an indication of how strongly stationary the speech signal is. More specifically, the value of this counter represents how strongly correlated the frames are that have been encoded since the counter was set to 0. Thus, if the value of the counter is 0, there is no correlation between the frames. As previously mentioned, this counter is set to 0 before the encoding of the speech signal is started. The counter is reset to 0 each time a frame is encoded with the weakly-predictive codebooks immediately after a frame is encoded with the strongly-predictive codebooks. Further, the amount by which this counter is incremented at various points in the pseudo-code is indicative of how strong the correlation is between the current frame and the previous frame, i.e., the larger the increment amount, the stronger the correlation.

The pseudo-code also refers to a counter threshold (which may also be referred to as a correlation threshold), an adaptive threshold and various scaled distortions and predetermined thresholds. These scaled distortions (including the scaling factors used), the predetermined thresholds, the counter threshold, and the adaptive threshold are explained in more detail in reference to FIG. 4 below. Further, the values of the scaling factors and the predetermined thresholds may be determined experimentally in one or more embodiments of the invention.

TABLE 1

| Pseudo-code |
|---|
| Compute erased frame parameter vector of previous frame with frame-erasure concealment; |
| Compute erased frame strongly-predictive parameter vector by multiplying strongly-predictive prediction matrix with erased frame parameter vector and adding mean vector and selected strongly-predictive codebook entry; |
| IF distortion of erased frame strongly-predictive parameter vector is less than scaled weakly-predictive distortion, increase counter by counter threshold; |
| IF weighted prediction error found by subtracting current frame parameter vector from product of strongly-predictive prediction matrix and previous frame's parameter vector is less than a pre-determined threshold, THEN increase counter by one; |
| ELSE IF strongly-predictive distortion is less than scaled weakly-predictive distortion, THEN |
| IF distortion of selected index of weakly-predictive codebook is larger than a pre-determined threshold and distortion of selected index of strongly-predictive codebook less than an adaptive threshold, THEN increase counter by a pre-determined amount (which is two in some embodiments of the invention); |
| ELSE increase counter by one; |
| ELSE IF strongly-predictive distortion less than a pre-determined threshold, THEN increase counter by one; |
| ELSE set counter to zero; |
| IF counter less than counter threshold, THEN force use of weakly predictive codebooks; |
| ELSE use other criteria to choose between the weakly predictive codebooks and the strongly predictive codebooks. |

Figure 3:
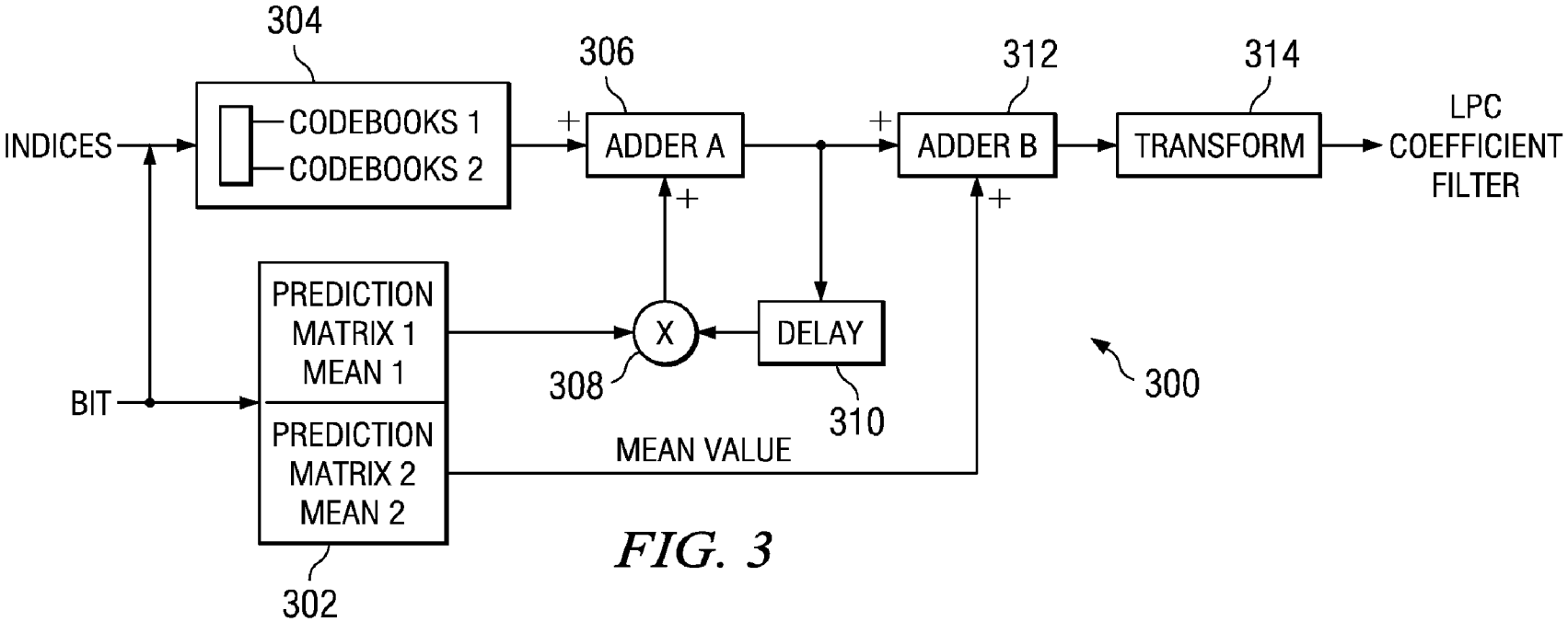
FIG. 3 shows a block diagram of a predictive decoder in accordance with one or more embodiments of the invention.

FIG. 3 shows a predictive decoder (300) for use with the predictive encoder of FIG. 2 in accordance with one or more embodiments of the invention. At the decoder (300), the indices for the codebooks from the encoding are received at the quantizer (304) with two sets of codebooks corresponding to codebook set 1 (the strongly-predictive codebooks) and codebook set 2 (the weakly-predicted codebooks) in the encoder. The bit from the encoder terminal (225 of FIG. 2) selects the appropriate codebook set used in the encoder. The LSF quantized input is added to the predicted value at adder A (606) to get the quantized mean-removed vector. The predicted value is the previous mean-removed quantized value from the delay (610) multiplied at the multiplier (608) by the prediction matrix from storage (602) that matches the one selected at the encoder. Both prediction matrix 1 and mean value 1 and prediction matrix 2 and mean value 2 are stored in storage (302) of the decoder. The 1 bit from the encoder terminal (225 of FIG. 2) selects the prediction matrix and the mean value in storage (302) that matches the encoder prediction matrix and mean value. The quantized mean-removed vector is added to the selected mean value at the adder B (312) to get the quantized LSF vector. The quantized LSF vector is transformed to LPC coefficients by the transformer (314).

Figure 4A:
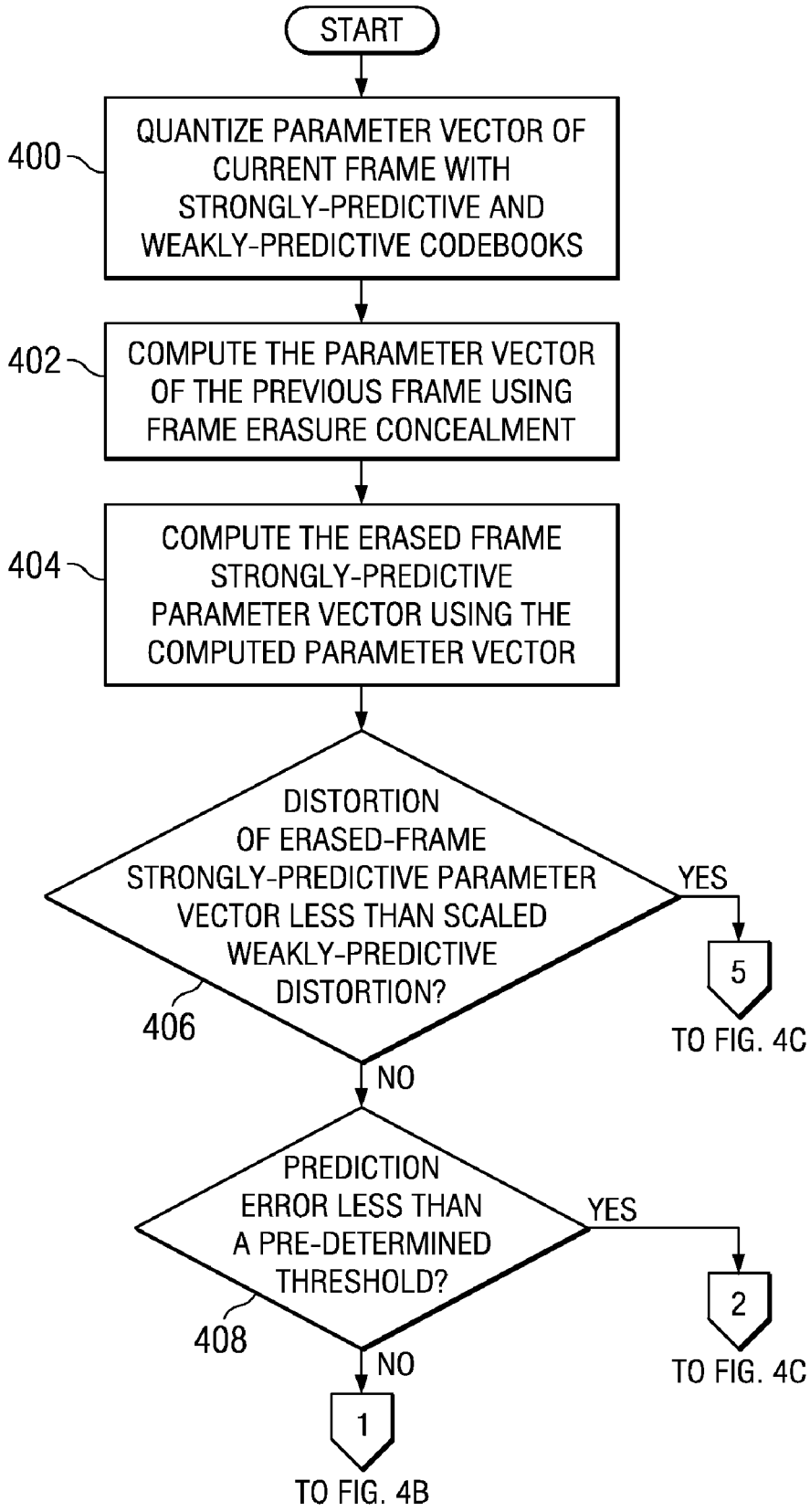
FIG. 4 shows a flow diagram of a method in accordance with one or more embodiments of the invention.
Figure 4B:
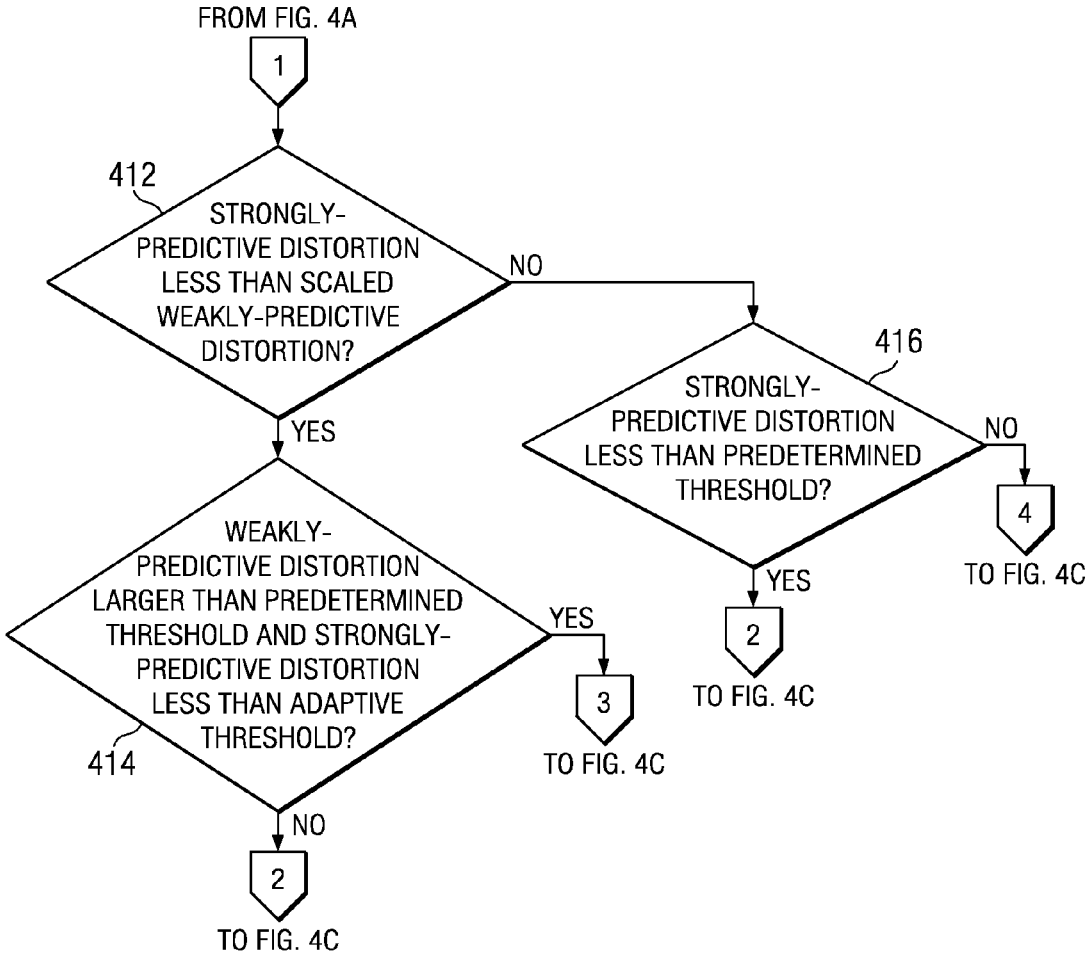
Figure 4C:
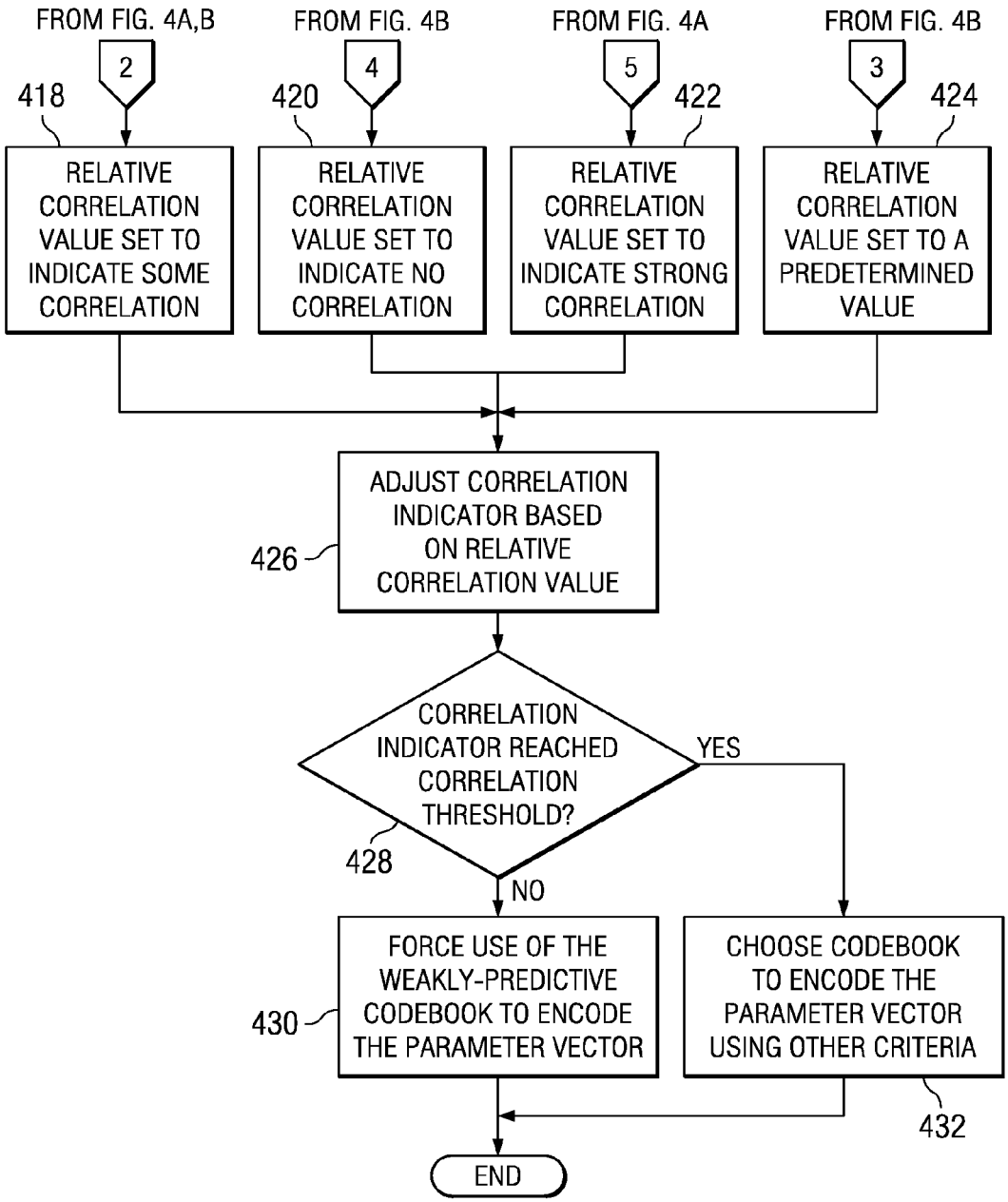

FIG. 4 shows a flow diagram of a method for switched-predictive encoding in accordance with one or more embodiments of the invention. More specifically, the method of FIG. 4 allows, under certain conditions, the use of a strongly-predictive codebook to encode the first stationary frame after a transition frame is encoded with the weakly predictive codebook rather than always forcing the use of the weakly predictive codebook for such a stationary frame as disclosed in the prior art. While the description of this method refers to a singular strongly-predictive codebook and a singular weakly-predictive codebook, one of ordinary skill will understand that other embodiments of the invention may use multiple such codebooks. In addition, although this method describes some techniques for representing the relative correlation of two consecutive frames and using that relative correlation to approximate the correlation strength of the speech signal, other techniques may be used without departing from the scope of the invention. For example, a correlation indicator could be decremented rather than incremented, different values could be used to represent relative correlation strengths, the direction of various comparisons (e.g., less than, greater than, etc.) could be changed, etc.

Embodiments of the method of FIG. 2 are applied to each frame in a speech signal. Further, the method is designed such that each time a frame of a speech signal is encoded using the weakly-predictive codebook immediately after a frame was encoded using the strongly-predictive codebook, a correlation indicator is set to indicate that there is no correlation in the speech signal at that point in time. In one or more embodiments of the invention, the correlation indicator is set to zero. As will be apparent in the description below, a frame encoded with weak prediction immediately after a frame encoded with strong prediction will not satisfy any of the conditions that test for correlation between two frames, thus causing the correlation indicator to be reset. For simplicity of description, the method is described as if the weakly predictive codebook has been used and the correlation indicator reset.

In the method of FIG. 4, the parameter vector of the current frame of a speech signal is quantized with both a strongly-predictive and a weakly-predictive codebook (400). The quantization with the strongly-predictive codebook results in a calculation of the distortion of the selected index of the strongly-predictive codebook, i.e., the strongly-predictive distortion. Similarly, the quantization with the weakly-predictive codebook results in the weakly-predictive distortion. Once the strongly-predictive distortion and the weakly-predictive distortion are computed, various conditions are checked to determine the relative correlation of the current frame to the previous frame.

First, a test is performed (402-406) to determine if there is sufficient correlation between the current frame and the previous frame to allow the use of the strongly-predictive codebook to encode the current frame, i.e., that any error due to frame erasure at the decoder if the strongly-predictive codebook used to encode the current frame will be smaller than the error if the weakly-predictive codebook is used. In this test, the parameter vector of the previous frame is computed using the frame erasure concealment technique that will be used in the decoder that receives the encoded frames (402). Then, the erased frame strongly-predictive parameter vector for the current frame is computed using the estimated parameter vector of the previous frame (404). The erased frame strongly-predictive parameter vector may be computed by multiplying the above computed parameter vector of the previous frame by the strongly-predictive prediction matrix and adding in the strongly-predictive mean vector and the entry from the strongly-predictive codebook selected during quantization of the current frame. The resulting erased frame strongly-predictive parameter vector is the same as the parameter vector that would be reconstructed in the decoder if the strongly-predictive codebook is used to encode the current frame and the previous frame is erased.

The distortion of the erased frame strongly-predictive parameter vector is then compared to the scaled weakly-predictive distortion (406). If the distortion of the erased frame strongly-predictive parameter vector is less than the scaled weakly-predictive distortion, then there is sufficient correlation between the current frame and the previous frame to allow the use of the strongly-predictive codebook to encode the current frame and a relative correlation value is set to indicate strong correlation (422). In one or more embodiments of the invention, the relative correlation value is set to the same value as the correlation threshold. Further, in one or more embodiments of the invention, the scale factor applied to the weakly predictive distortion is 1.15.

In embodiments of the invention, the relative correlation value is indicative of the relative correlation of two consecutive frames (e.g., the current frame and the previous frame). In one or more embodiments of the invention, the relative correlation value is a value that indicates whether there is no correlation, some correlation, or strong correlation between the two frames. In some embodiments of the invention, the relative correlation value is zero if there is no correlation, one if there is some correlation, and the correlation threshold if there is strong correlation. As is described below, the relative correlation value may also be set to a predetermined value under some conditions.

Returning to FIG. 4, if the distortion of the erased frame strongly-predictive parameter vector is not less than the scaled weakly-predictive distortion, then further testing is performed to determine the relative correlation between the current frame and the previous frame. More specifically, the weighted prediction error between the current frame and the previous frame is checked (408). If this prediction error is sufficiently low, there is some correlation between the current frame and the previous frame. The weighted prediction error may be computed by finding the weighed squared difference between the parameter vector of the current frame and the product of the strongly-predictive prediction matrix and the parameter vector of the previous frame. If the computed weighted prediction error is less than a predetermined prediction threshold, then there is sufficient correlation between the two frames to indicate that some correlation is present and the relative correlation value is set to indicate some correlation (418). In one or more embodiments of the invention, the predetermined prediction threshold is 1,118,000 for wideband signals and 1,700,000 for narrowband signals when the weighting function described in U.S. Pat. No. 6,122,608 is used.

If the computed prediction error is not less than the predetermined prediction threshold, further testing is performed to determine the relative correlation between the current frame and the previous frame. First, the strongly-predictive distortion is compared to the scaled weakly-predictive distortion to decide what additional testing is to be performed (412). In one or more embodiments of the invention, the scale factor applied to the weakly-predictive distortion is 1.05. If the strongly-predictive distortion is less than the scaled weakly-predictive distortion, then there is sufficient correlation between the two frames that use of the strongly-predictive codebook produces better results for the current frame than the weakly-predicted codebook. Accordingly, a test is performed to determine how much better use of the strongly-predictive codebook would be than use of the weakly-predictive codebook.

In this test, the weakly-predictive distortion is compared to a predetermined threshold and the strongly-predictive distortion is compared to an adaptive threshold (414). In one or more embodiments of the invention, this adaptive threshold adapts to the amount of weakly-predictive distortion. That is, the lower the weakly-predictive distortion, the lower the adaptive threshold will be and vice versa. In some embodiments of the invention, the adaptive threshold $TH_3$ is computed as follows:

$$TH_3 = \frac{\varepsilon_{wk} - TH_{LW}}{TH_{HG} - TH_{LW}}\left[\left(\frac{TH_{HG}}{S_{HG}}\right) - \left(\frac{TH_{LW}}{S_{LW}}\right)\right] + \frac{TH_{LW}}{S_{LW}}, \quad (4)$$

where $TH_{LW}$ and $TH_{HG}$ are low and high distortion thresholds, $S_{LW}$ and $S_{HG}$ are scale factors for low and high distortion, and $\epsilon_{wk}$ is the weakly-predictive distortion of the current frame. In one or more embodiments of the invention, $TH_{LW}$ is 125,000 (1.45 dB), $TH_{HG}$ is 200,000 (1.85 dB), $S_{LW}$ is 5, and $S_{HG}$ is 1.5.

If the weakly-predictive distortion is larger than the low distortion threshold, $TH_{LW}$, and the strongly-predictive distortion is less than the adaptive threshold, $TH_3$, then use of the strongly-predictive codebook produces much better results for the current frame than use of the weakly-predictive codebook, and the relative correlation value is set to a predetermined value (424). This predetermined value is selected based on how much a positive outcome of this test should be allowed to contribute to the correlation indicator, i.e., how much weight should be given to fact that use of the strongly-predictive codebook would be much better than use of the weakly predictive codebook. In one more embodiments of the invention, this predetermined value is the same as the correlation threshold, thus indicating strong correlation between the frames. However, if the weakly-predictive distortion is not larger than the low distortion threshold, $TH_{LW}$, or the strongly-predictive distortion is less than the adaptive threshold, $TH_3$, then use of the strongly-predictive codebook does not produce sufficiently better results for the current frame than use of the weakly-predictive codebook, and the relative correlation value is set to indicate some correlation between the frames (418).

Returning to the comparison of the strongly-predictive distortion to the scaled weakly-predictive distortion (412), if the strongly-predictive distortion is not less than the scaled weakly-predictive distortion, then the amount if correlation between the two frames is such that use of the weakly-predictive codebook produces better results for the current frame than the strongly-predicted codebook. However, the strongly-predictive distortion resulting from use of the strongly-predicted codebook may be low enough to indicate that there is some correlation between the frames. Accordingly, the strongly-predicted distortion is compared to a predetermined threshold and if the strongly-predicted distortion is less than this predetermined threshold, the relative correlation value is set to indicate some correlation (418). Otherwise, the relative correlation value is set to indicate no correlation (420). In one or more embodiments of the invention, the predetermined threshold is 50.000 (1 dB).

Once the relative correlation value is set (418, 420, 422, or 424), it is used to adjust the correlation indicator (426). If the relative correlation value indicates no correlation, the correlation indicator is set to indicate no correlation or if the relative correlation value indicates strong correlation, the correlation indicator is set to indicate strong correlation. Otherwise, the relative correlation value is added to the correlation indicator.

After the correlation indicator is adjusted, the correlation indicator is used to decide whether or not use of the weakly-predictive codebook should be forced for the current frame (428). More specifically, if the correlation indicator has not reached a predetermined correlation threshold, the use of the weakly-predicted codes is forced for encoding the parameter vector (430). Otherwise, the codebook to encode the parameter vector may be chosen using other criteria, i.e., either codebook may be used for encoding depending on the outcome of the application of the other criteria.

Figure 5:
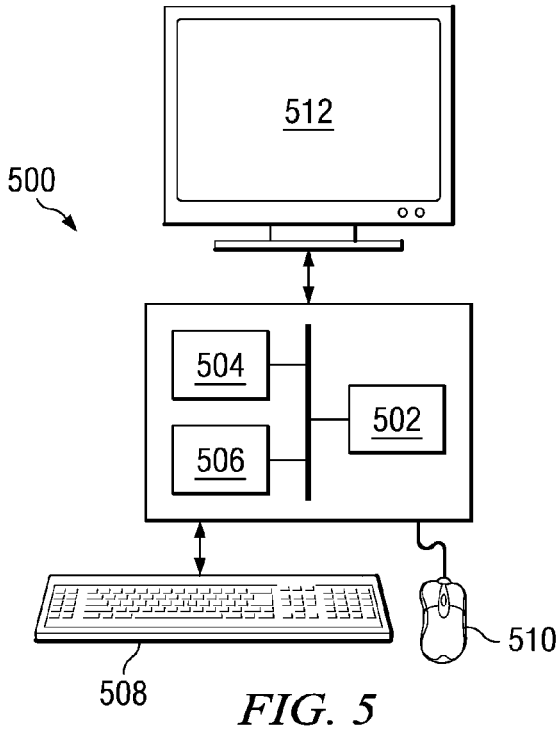
FIG. 5 shows an illustrative digital system in accordance with one or more embodiments.

Embodiments of the methods and encoders described herein may be implemented on virtually any type of digital system (e.g., a desk top computer, a laptop computer, a handheld device such as a mobile phone, a personal digital assistant, an MP3 player, an iPod, etc.). For example, as shown in FIG. 5, a digital system (500) includes a processor (502), associated memory (504), a storage device (506), and numerous other elements and functionalities typical of today's digital systems (not shown). In one or more embodiments of the invention, a digital system may include multiple processors and/or one or more of the processors may be digital signal processors. The digital system (500) may also include input means, such as a keyboard (508) and a mouse (510) (or other cursor control device), and output means, such as a monitor (512) (or other display device). The digital system (500) may be connected to a network (514) (e.g., a local area network (LAN), a wide area network (WAN) such as the Internet, a cellular network, any other similar type of network and/or any combination thereof) via a network interface connection (not shown). Those skilled in the art will appreciate that these input and output means may take other forms.

Further, those skilled in the art will appreciate that one or more elements of the aforementioned digital system (500) may be located at a remote location and connected to the other elements over a network. Further, embodiments of the invention may be implemented on a distributed system having a plurality of nodes, where each portion of the system and software instructions may be located on a different node within the distributed system. In one embodiment of the invention, the node may be a digital system. Alternatively, the node may be a processor with associated physical memory. The node may alternatively be a processor with shared memory and/or resources. Further, software instructions to perform embodiments of the invention may be stored on a computer readable medium such as a compact disc (CD), a diskette, a tape, a file, or any other computer readable storage device.

While the invention has been described with respect to a limited number of embodiments, those skilled in the art, having benefit of this disclosure, will appreciate that other embodiments can be devised which do not depart from the scope of the invention as disclosed herein. For example, instead of an AMR-WB type of CELP, a G.729 or other type of CELP may be used in one or more embodiments of the invention. Further, the number of codebook/prediction matrix pairs may be varied in one or more embodiments of the invention. In addition, in one or more embodiments of the invention, other parametric or hybrid speech encoders/encoding methods may be used with the techniques described herein (e.g., mixed excitation linear predictive coding (MELP)). The quantizer may also be any scalar or vector quantizer in one or more embodiments of the invention. Accordingly, the scope of the invention should be limited only by the attached claims.

It is therefore contemplated that the appended claims will cover any such modifications of the embodiments as fall within the true scope and spirit of the invention.

What is claimed is:

1. A method for predictive encoding comprising:

quantizing a parameter vector of an input frame with a strongly-predictive codebook and a weakly-predictive codebook to obtain a strongly-predictive distortion and a weakly-predictive distortion;

adjusting a correlation indicator based on a relative correlation of the input frame to a previous frame, wherein the correlation indicator is indicative of the strength of the correlation of previously encoded frames;

encoding the input frame with the weakly-predictive codebook unless the correlation indicator has reached a correlation threshold; and wherein adjusting the correlation indicator further comprises using frame erasure concealment to determine the relative correlation of the input frame to the previous frame and wherein using the frame erasure concealent erasure comprises:

computing a parameter vector of the previous frame with the frame erasure concealment;

computing an erased frame strongly-predictive parameter vector of the input frame using the parameter vector of the previous frame; and comparing a distortion of the erased frame strongly-predictive parameter vector to the weakly-predictive distortion scaled by a predetermined scale factor to determine the relative correlation.

2. The method of claim 1, wherein adjusting the correlation indicator further comprises:

using an adaptive threshold to determine the relative correlation of the input frame to the previous frame, wherein the adaptive threshold adapts to the weakly-predictive distortion.

3. The method of claim 2, wherein using an adaptive threshold further comprises:

comparing the strongly-predictive distortion to the adaptive threshold;

comparing the weakly-predictive distortion to a predetermined threshold; and determining the relative correlation based on the comparing of the strongly-predictive distortion and the comparing of the weakly-predictive distortion.

4. The method of claim 2, wherein using the adaptive threshold further comprises:

if the strongly-predictive distortion is less than a scaled value of the weakly-predictive distortion, setting a relative correlation value to a first predetermined amount if the weakly-predictive distortion is larger than a first predetermined threshold and the strongly-predictive distortion is less than an adaptive threshold; and setting the relative correlation value to a second predetermined amount that indicates less correlation than the first predetermined amount if the weakly-predictive distortion not larger than the first predetermined threshold or the strongly-predictive distortion is not less than the adaptive threshold; and if the strongly-predictive distortion is not less than the scaled value of the weakly-predictive distortion, setting the relative correlation value to the second predetermined amount if the strongly-predictive distortion is less than a second predetermined threshold; and setting the relative correlation value to a third predetermined amount that indicates no correlation if the strongly-predictive distortion is not less than the second predetermined threshold.

5. The method of claim 1, wherein adjusting the correlation indicator further comprises:

using the strongly-predictive distortion and the weakly-predictive distortion to determine the relative correlation of the input frame to the previous frame.

6. The method of claim 1, wherein adjusting the correlation indicator further comprises:

computing a weighted prediction error between the parameter vector of the input frame and a parameter vector of the previous frame; and using the weighted prediction error to determine the relative correlation of the input frame to the previous frame.

7. The method of claim 6, wherein computing the weighted prediction error further comprises subtracting the parameter vector of the input frame from the product of a prediction matrix of the strongly-predictive codebook and the parameter vector of the previous frame; and using the weighted prediction error further comprises comparing the weighted prediction error to a predetermined threshold.

8. The method of claim 1, further comprising:

selecting one of the weakly-predictive codebook and the strongly-predictive codebook to encode the input frame when the correlation indicator has reached the correlation threshold.

9. An encoder of a digital processor for encoding input frames, wherein encoding an input frame comprises:

quantizing a parameter vector of an input frame with a strongly-predictive codebook and a weakly-predictive codebook to obtain a strongly-predictive distortion and a weakly-predictive distortion;

adjusting a correlation indicator based on a relative correlation of the input frame to a previous frame, wherein the correlation indicator is indicative of the strength of the correlation of previously encoded frames; and encoding via the digital processor the input frame with the weakly-predictive codebook unless the correlation indicator has reached a correlation threshold;

wherein adjusting the correlation indicator further comprises using frame erasure concealment to determine the relative correlation of the input frame to the previous frame and wherein using the frame erasure concealent erasure comprises:

computing a parameter vector of the previous frame with the frame erasure concealment;

computing an erased frame strongly-predictive parameter vector of the input frame using the parameter vector of the previous frame; and comparing a distortion of the erased frame strongly-predictive parameter vector to the weakly-predictive distortion scaled by a predetermined scale factor to determine the relative correlation.

10. The encoder of claim 9, wherein adjusting the correlation indicator further comprises:

using an adaptive threshold to determine the relative correlation of the input frame to the previous frame, wherein the adaptive threshold adapts to the weakly-predictive distortion.

11. The encoder of claim 10, wherein using an adaptive threshold further comprises:

comparing the strongly-predictive distortion to the adaptive threshold;

comparing the weakly-predictive distortion to a predetermined threshold; and determining the relative correlation based on the comparing of the strongly-predictive distortion and the comparing of the weakly-predictive distortion.

12. The encoder of claim 9, wherein adjusting the correlation indicator further comprises:

using the strongly-predictive distortion and the weakly-predictive distortion to determine the relative correlation of the input frame to the previous frame.

13. The encoder of claim 9, wherein adjusting the correlation indicator further comprises:

computing a weighted prediction error between the parameter vector of the input frame and a parameter vector of the previous frame; and using the weighted prediction error to determine the relative correlation of the input frame to the previous frame.

14. The encoder of claim 13, wherein computing the weighted prediction error further comprises subtracting the parameter vector of the input frame from the product of a prediction matrix of the strongly-predictive codebook and the parameter vector of the previous frame; and using the weighted prediction error further comprises comparing the weighted prediction error to a predetermined threshold.

15. The encoder of claim 9, wherein encoding an input frame further comprises:

selecting one of the weakly-predictive codebook and the strongly-predictive codebook to encode the input frame when the correlation indicator has reached the correlation threshold.

16. A digital system comprising an encoder for encoding input frames, wherein encoding an input frame comprises:

quantizing a parameter vector of the input frame with a strongly-predictive codebook and a weakly-predictive codebook to obtain a strongly-predictive distortion and a weakly-predictive distortion;

adjusting a correlation indicator based on a relative correlation of the input frame to a previous frame, wherein the correlation indicator is indicative of the strength of the correlation of previously encoded frames; and encoding in the digital system the input frame with the weakly-predictive codebook unless the correlation indicator has reached a correlation threshold wherein using the frame erasure concealent erasure comprises:

computing a parameter vector of the previous frame with the frame erasure concealment;

computing an erased frame strongly-predictive parameter vector of the input frame using the parameter vector of the previous frame; and comparing a distortion of the erased frame strongly-predictive parameter vector to the weakly-predictive distortion scaled by a predetermined scale factor to determine the relative correlation.

* * * * *